US008905712B2

(12) United States Patent
Burdgick et al.

(10) Patent No.: US 8,905,712 B2
(45) Date of Patent: Dec. 9, 2014

(54) SUPPORT BAR FOR STEAM TURBINE NOZZLE ASSEMBLY

(75) Inventors: Steven Sebastian Burdgick, Schenectady, NY (US); Prashant Prabhakar Sankolli, Bangalore (IN); Dominick Joseph Werther, Albany, NY (US)

(73) Assignee: General Electric Company, Schenectady, NY (US)

( * ) Notice: Subject to any disclaimer, the term of this patent is extended or adjusted under 35 U.S.C. 154(b) by 1130 days.

(21) Appl. No.: 12/755,521

(22) Filed: Apr. 7, 2010

(65) Prior Publication Data

US 2011/0250063 A1 Oct. 13, 2011

(51) Int. Cl.

| | |
|---|---|
| ***F01D 25/26*** | (2006.01) |
| ***F01D 25/28*** | (2006.01) |
| ***F04D 29/60*** | (2006.01) |
| ***F01D 25/24*** | (2006.01) |

(52) U.S. Cl.

CPC ..... *F01D 25/246* (2013.01)
USPC ..... 415/213.1; 415/214.1

(58) Field of Classification Search

CPC ..... F01D 25/24; F01D 25/243; F01D 25/246; F01D 1/02; F01D 9/00; F01D 9/04
USPC ..... 415/213.1, 214.1, 220
See application file for complete search history.

(56) References Cited

U.S. PATENT DOCUMENTS

| | | | | |
|---|---|---|---|---|
| 6,352,405 | B1 * | 3/2002 | Tomko | 415/209.2 |
| 6,547,523 | B2 * | 4/2003 | Nelligan | 415/209.2 |
| 7,329,098 | B2 * | 2/2008 | Burdgick | 415/213.1 |
| 2008/0317591 | A1 * | 12/2008 | Golinkin et al. | 415/213.1 |
| 2013/0108437 | A1 * | 5/2013 | Golinkin et al. | 415/213.1 |

* cited by examiner

*Primary Examiner* — Ned Landrum
*Assistant Examiner* — Su Htay
(74) *Attorney, Agent, or Firm* — Hoffman Warnick LLC; Ernest G. Cusick

(57) ABSTRACT

A support bar for a steam turbine nozzle assembly is disclosed. In one embodiment, the support bar includes a hook-shaped portion for engaging a lip portion of a steam turbine diaphragm, wherein the steam turbine support bar is configured to non-affixedly join a steam turbine casing to the steam turbine diaphragm.

15 Claims, 11 Drawing Sheets

SUPPORT BAR FOR STEAM TURBINE NOZZLE ASSEMBLY

BACKGROUND OF THE INVENTION

The subject matter disclosed herein relates to a steam turbine nozzle assembly, or diaphragm stage. Specifically, the subject matter disclosed herein relates to a support bar for a steam turbine nozzle assembly.

Steam turbines include static nozzle assemblies that direct flow of a working fluid into turbine buckets connected to a rotating rotor. The nozzle construction (including a plurality of nozzles, or "airfoils") is sometimes referred to as a "diaphragm" or "nozzle assembly stage." Steam turbine diaphragms include two halves, which are assembled around the rotor, creating horizontal joints between these two halves. Each turbine diaphragm stage is vertically supported by support bars, support lugs or support screws on each side of the diaphragm at the respective horizontal joints. The horizontal joints of the diaphragm also correspond to horizontal joints of the turbine casing, which surrounds the steam turbine diaphragm.

Support bars are typically attached horizontally to the bottom half of the diaphragm stage near the horizontal joints by bolts. The typical support bar includes a tongue portion that fits into a pocket which is machined into the diaphragm. This support bar also includes an elongated portion which sits on a ledge of the turbine casing. Performing diaphragm maintenance may require accessing the bottom half of the diaphragm, which is incapable of rotating about the turbine rotor due to the support bars and a centering pin coupling the bottom half of diaphragm to the casing. Additionally, removal of the bottom half of the diaphragm may also be necessary in order to align the bottom half with the horizontal joint of the casing. In order to access the bottom half of the diaphragm, a number of time-consuming and costly steps could be undertaken.

BRIEF DESCRIPTION OF THE INVENTION

A steam turbine nozzle support bar is disclosed. In one embodiment, the steam turbine support bar includes a hook-shaped portion for engaging a lip portion of a steam turbine diaphragm, wherein the steam turbine support bar is configured to non-affixedly join a steam turbine casing to the steam turbine diaphragm.

A first aspect of the invention includes a steam turbine support bar including a hook-shaped portion for engaging a lip portion of a steam turbine diaphragm, wherein the steam turbine support bar is configured to non-affixedly join a steam turbine casing to the steam turbine diaphragm.

A second aspect of the invention includes a steam turbine nozzle support assembly comprising: a steam turbine casing; and a semi-annular diaphragm segment at least partially housed within the steam turbine casing, the semi-annular diaphragm segment having a horizontal joint surface and a lip portion for non-affixedly engaging a hook-shaped portion of a steam turbine support bar.

A third aspect of the invention includes a steam turbine apparatus comprising: a casing having a horizontal joint surface; a rotor within the casing; and a steam turbine nozzle support assembly including: a semi-annular diaphragm segment at least partially housed within the casing, the semi-annular diaphragm segment having a slot; and a support bar removably arranged between the casing and the semi-annular diaphragm segment, the support bar including: a body portion, a first flange extending substantially perpendicularly from the body portion and substantially filling the slot, and a second flange extending substantially perpendicularly from the body portion over the horizontal joint surface.

BRIEF DESCRIPTION OF THE DRAWINGS

These and other features of this invention will be more readily understood from the following detailed description of the various aspects of the invention taken in conjunction with the accompanying drawings that depict various embodiments of the invention, in which.

It is noted that the drawings of the invention are not to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

Aspects of the invention provide for a support bar for a steam turbine nozzle assembly. This support bar may be removably affixed to a semi-annular diaphragm segment in an axial direction, and may allow for removal and/or repair of components of the steam turbine nozzle assembly without the need to remove the steam turbine rotor.

Figure 1:
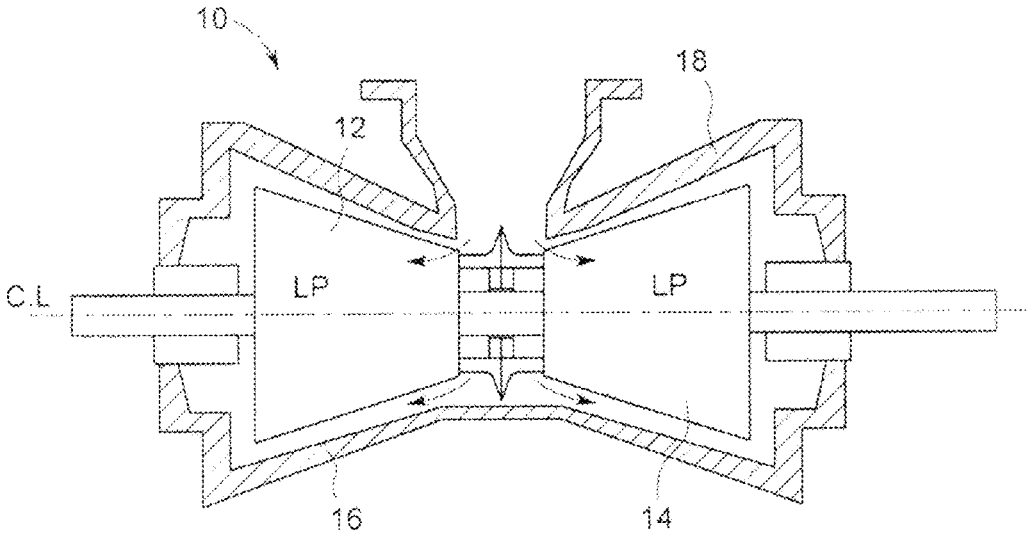
FIG. 1(PRIOR ART)
FIG. 1 shows a partial cross-sectional schematic of a double-flow steam turbine according to the prior art.
Figure 2:
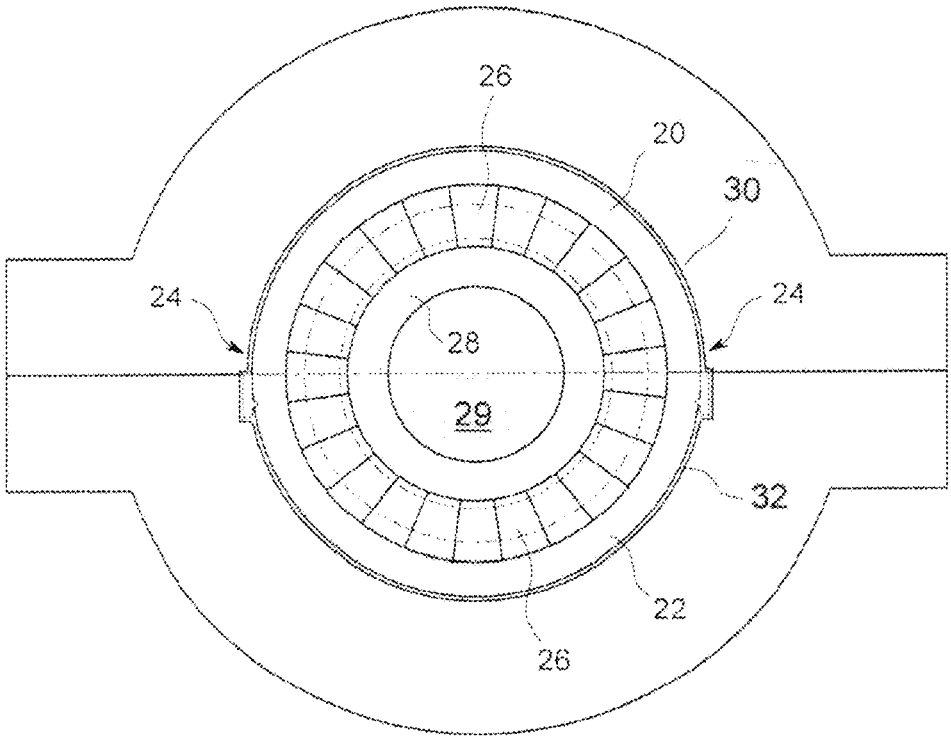
FIG. 2(PRIOR ART)
FIG. 2 shows a general schematic end elevation of a pair of annular diaphragm ring segments joined at a horizontal split surface according to the prior art.

Turning to FIG. 1, a partial cross-sectional schematic of a double-flow steam turbine 10 (e.g., a low-pressure steam turbine) according to the prior art is shown. Double-flow steam turbine 10 may include a first low-pressure (LP) section 12 and a second LP section 14, surrounded by first and second diaphragm assemblies 16, 18, respectively (including casing sections and diaphragm ring segments housed therein). As shown in FIG. 2, each diaphragm assembly 16, 18 includes a pair of semi-annular diaphragm ring segments 20, 22, which are joined at a horizontal joint surface 24. Diaphragm ring segments 20, 22 are housed within casing segments 30, 32, respectively, which are also joined at horizontal joint surface 24. Each semi-annular diaphragm ring segment 20, 22, supports a semi-annular row of turbine nozzles 26 and an inner web 28, as is known in the art. The diaphragm ring segments 20, 22 collectively surround a rotor 29 (shown in phantom), as is known in the art.

Figure 3:
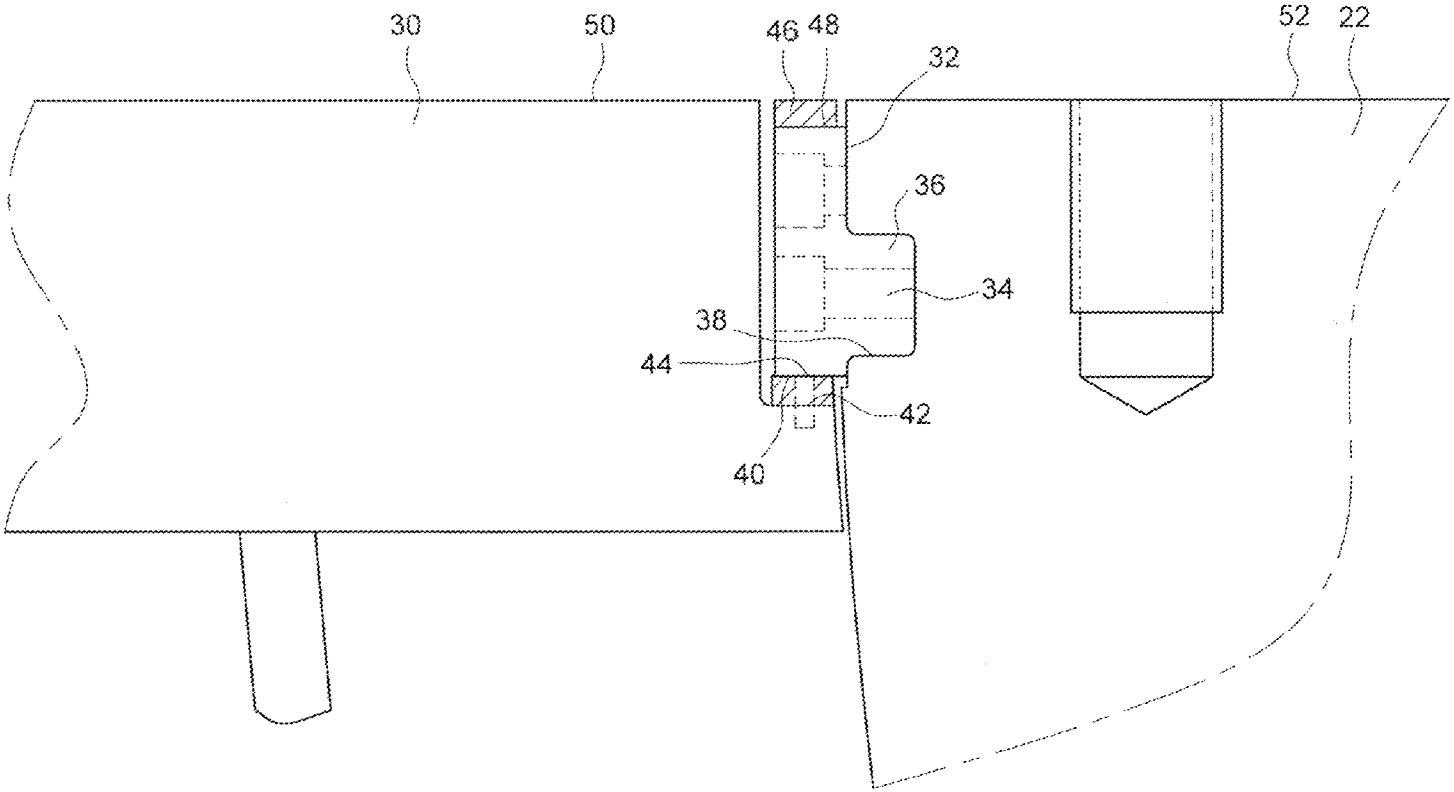
FIG. 3(PRIOR ART)
FIG. 3 shows a partial end elevation of a steam turbine nozzle support assembly according to the prior art.

Turning to FIG. 3, a prior art support assembly for a steam turbine diaphragm is shown. Specifically, FIG. 3 is a close-up view of a portion of the lower semi-annular diaphragm ring segment (or simply, lower diaphragm segment) 22 of FIG. 2, which is affixedly coupled to a lower turbine casing half (or simply, casing) 30. Lower diaphragm segment 22 is shown to be vertically supported within casing 30 by a support bar 32, as is known in the art. Support bar 32 is bolted to lower diaphragm segment 22 by bolt(s) 34 extending through support bar 32. At least one bolt 34 may extend through a radially inwardly directed flange 36 of support bar 32. Flange 36 is received in a mating slot 38 in lower diaphragm segment 22.

Support bar 32 otherwise extends vertically along casing 30 on one side and diaphragm segment 22 on the other side. A lower surface 40 of the support bar faces a shoulder 42 formed in casing 30, with a shim block (or simply, shim) 44 interposed between shoulder 42 and lower surface 40. Shim 44 is typically bolted to casing 30. A second shim block 46 is shown seated on an upper surface 48 of support bar 32 to effectively make the upper end of support bar flush with horizontal joint surfaces 50, 52 of casing 30 and lower diaphragm segment 22, respectively. This arrangement allows support bar 32 to be sandwiched between the upper and lower casing sections (upper casing omitted). The other side of lower diaphragm segment 22 is similarly supported on the opposite side of the casing (other side omitted for clarity).

Performing vertical diaphragm alignment (alignment of horizontal joint surfaces 50, 52) or performing maintenance on diaphragm segment 22 (and components included therein) requires removal of the upper half of the casing, along with upper diaphragm segment 20 (FIG. 2). Further, because support bar 32 couples lower diaphragm segment 22 to casing 30, and due to the presence of a centering pin (not shown) coupling the diaphragm to the casing, lower diaphragm segment 22 cannot be rotated around rotor 29 (FIG. 2) while housed within casing 30 (due to a lack of clearance). Due to this limited clearance, the positioning of bolts 34 in support bars 32, and the presence of the centering pin, the lower diaphragm segment 22 must be removed vertically from casing 30 in order to access support bars 32. This requires removing rotor 29, and subsequently lifting lower diaphragm segment 22 vertically in order to remove bolts 34. This process is both time consuming and costly.

Figure 4:
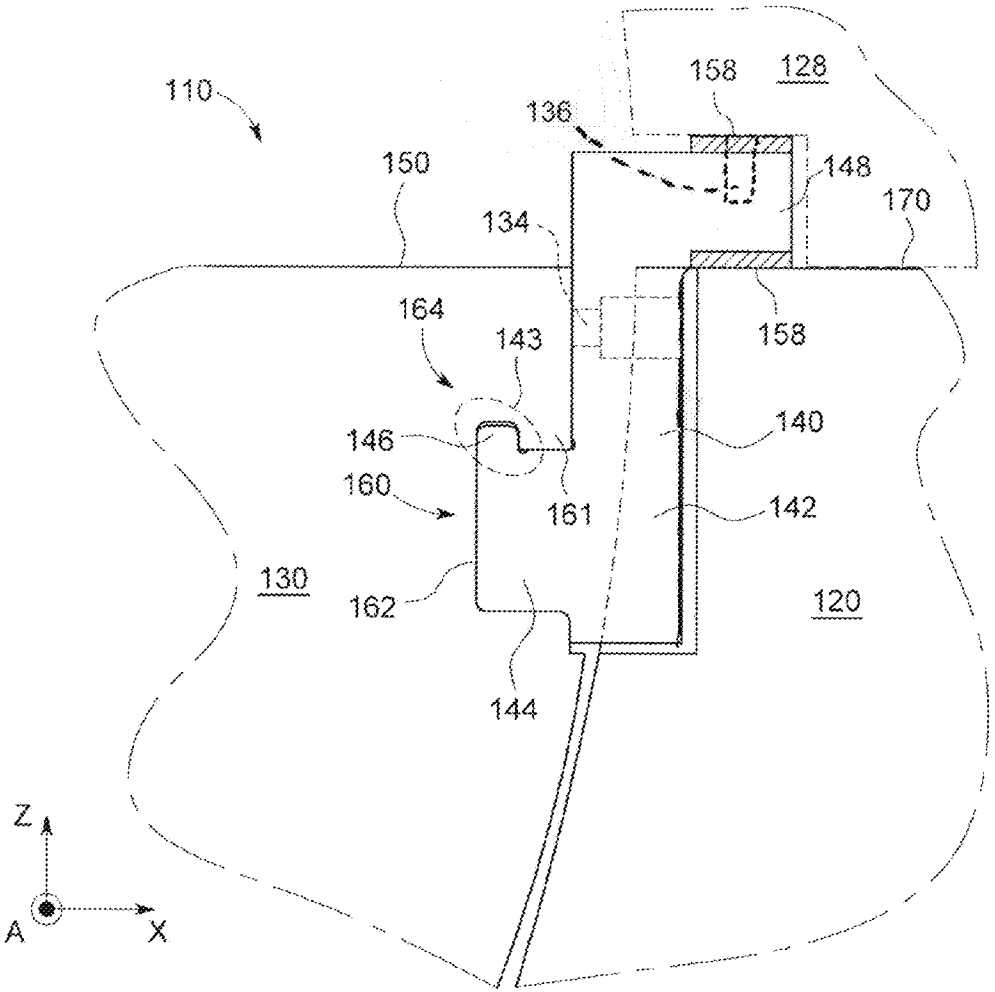
FIGS. 4-11 show partial end elevations of steam turbine nozzle support assemblies according to embodiments of the invention.

Turning to FIG. 4, a steam turbine nozzle support assembly 110 is shown according to an embodiment of the invention. As used herein, the directional key in the lower left-hand portion of FIGS. 4-11 (and similarly shown, but distinctly oriented in FIG. 12) is provided for ease of reference. As shown, this key is oriented with respect to the close-up views of portions of steam turbine support assemblies described herein. For example, as used in FIGS. 4-11, which show front views of steam turbine support assemblies, the "z" axis represents vertical (or radial) orientation, "x" represents horizontal (or radial) orientation, and the "A" axis (into and out of the page) represents axial orientation (along the axis of the turbine rotor, omitted for clarity). In one embodiment, steam turbine nozzle support assembly 110 includes a steam turbine casing half (or simply, casing) 120 and a semi-annular diaphragm segment 130 at least partially housed within casing 120. Also shown in FIG. 4 is a support bar 140 which may include a hook-shaped portion (or simply, hook) 143 (indicated by phantom circle) for engaging a lip portion (or simply, lip) 161 of semi-annular diaphragm segment 130. For illustrative purposes, an upper steam turbine casing half (or simply, upper casing) 128 is also shown. As described further herein, in some embodiments, upper casing 128 may be formed with a slot to receive an upper flange (e.g., upper flange 148) of a support bar (e.g., support bar 140). As described further herein, in contrast to support bar 32 of the prior art (FIG. 3), in one embodiment, support bar 140 is configured to non-affixedly join casing 120 to semi-annular diaphragm segment 130. In other words, the configuration of support bar 140 including hook 143 allows it to be removably arranged between steam turbine casing 120 and semi-annular diaphragm segment 130 such that support bar 140 is not affixed to either of casing 120 or semi-annular diaphragm segment 130 (e.g., by bolts, screws, adhesive, or other fixation mechanisms). However, despite not being affixed to either of steam turbine diaphragm 130 or steam turbine casing 120, support bar 140 including hook 143 is configured to at least partially join steam turbine diaphragm 130 to steam turbine casing 120. That is, support bar 140 including hook 143 is configured to engage the lip portion 161 of the semi-annular diaphragm segment (steam turbine diaphragm) 130 without a screw, a bolt, or an adhesive.

As indicated above, support bar 140 may include hook-shaped portion 143. In one embodiment, hook-shaped portion 143 may include any arced, angled, or curved portion of support bar 140 capable of non-affixedly engaging lip portion 161 of semi-annular diaphragm segment 130. As is described further herein, in one embodiment, hook-shaped portion 143 may include portions of one or more flanges, bosses, or protrusions.

With continuing reference to FIG. 4, semi-annular diaphragm segment 130 includes a horizontal joint surface 150 and a slot 160. Slot 160 may include a first portion 162 extending substantially parallel to horizontal joint surface 150, and a second portion 164 extending substantially perpendicularly from first portion 162. As shown, portions (including e.g., hook 143) of support bar 140 may complement first portion 162 and second portion 164 of slot 160. For example, as shown in FIG. 4, support bar 140 may include a body portion 142, a first flange (or boss) 144 extending substantially perpendicularly from body portion 142, and a second flange (or boss) 146 extending substantially perpendicularly from first flange 144 so as to form hook 143. That is, first flange 144 and second flange 146 may collectively form hook 143. Hook 143 may non-affixedly engage lip portion 161 of semi-annular diaphragm segment 130, where lip portion 161 may be a flange, boss, or other protrusion extending from semi-annular diaphragm segment 130 toward slot 160. As noted herein, the hook 143 (hook-shaped portion) is a substantially unitary structure without any apertures therethrough, and the first flange 144 and the second flange 146 forming the hook 143 engage the lip portion 161 of the semi-annular diaphragm segment 130 without a screw, a bolt, or an adhesive. In one embodiment, lip portion 161 may extend away from horizontal joint surface 150 downwardly (in the z direction).

As is further shown in FIG. 4, in one embodiment, support bar 140 may include a fourth flange (or simply, upper flange) 148 extending substantially perpendicularly from body portion 142 and radially outwardly over an upper surface 170 of casing 120. In other words, upper flange 148 may extend from body portion 142 in a direction opposite of hook-shaped portion 143 to engage upper surface 170. As will be described further herein, upper flange 148 may allow for e.g., an operator or maintenance personnel to adjust the position of horizontal joint surface 150 relative to upper surface 170. That is, adjustment of the position of upper flange 148 may allow for alignment of horizontal joint surface 150 and upper surface 170. This may be performed, for example, by inserting a shim 158 between upper surface 170 and upper flange 148 to separate upper flange 148 from upper surface 170. In the case where incremental adjustment of the position of upper flange 148 is desirable, shim 158 may be accessed (and, e.g., later machined) without removing semi-annular diaphragm segment 130 and rotor (e.g., rotor 29 of FIG. 2). As noted above, upper flange 148 may function as an overhanging support mechanism for support bar 140, and may allow for alignment of horizontal joint surface 150 and upper surface 170. Upper flange 148 may further eliminate the need for a first shim and bolt mechanism (e.g., shim 44 and bolt 34 shown in FIG. 3) below horizontal joint surface 150 and upper surface 170 to hold support bar 140 in its operative position. Further shown in this embodiment is an additional shim 158, which may be placed between an upper surface of upper flange 148, and a lower surface of upper casing half 128 (shown partially in phantom). This additional shim 158 may further aid in keeping support bar 140 in its proper position during operation of a steam turbine including steam turbine nozzle assembly 110.

As noted above, embodiments of support bar 140 including upper flange 148 may not include a bolt 134 affixing support bar 140 to semi-annular diaphragm segment 130. In these embodiments, hook 143 may be a unitary structure without apertures therethrough. Where support bar 140 does not include these bolts 134 extending therethrough, greater clearance is created for bolts (not shown) to extend downwardly (in the z direction) through horizontal joint surface 150 and into semi-annular diaphragm segment 130. This may allow for larger (longer, thicker) bolts and bolt holes (or other coupling mechanisms) to couple semi-annular diaphragm segment 130 to an upper semi-annular diaphragm segment (e.g., diaphragm ring segment 20 of FIG. 2). Additionally, support bar 140 including upper flange 148 may reduce clearance concerns caused by bolts or shims (e.g., shim 44 of FIG. 3) located below horizontal joint surface 150. During operation of the steam turbine, temperatures below horizontal joint surface 150 may be greater than those at the surface. The greater temperatures below the surface may cause thermal expansion of components such as shims or bolts. This thermal expansion may adversely affect adjustment of a support bar. In the case where shims 158 are located above horizontal joint surface 150 (and upper surface 170), the thermal expansion effects may be reduced.

Although the support bar 140 of FIG. 4, along with other support bars shown and described herein, are capable of non-affixedly joining casing 120 to semi-annular diaphragm segment 130, use of bolts to secure one or more portions of support bar 140 to at least one of casing 120 and semi-annular diaphragm segment 130 is still possible. As shown in phantom in FIG. 4, bolts 134 may optionally be used to affix one or more portions of support bar to semi-annular diaphragm segment 130. Further, although hook 143 is shown (in phantom circle), alternate embodiments of the invention may include a support bar including an upper flange (e.g., upper flange 148), but without hook 143 (e.g., without second flange 146). In these cases, bolts 134 may be used to affix the body 142 and/or first flange 144 of support bar 140 to semi-annular diaphragm segment 130. In this case, upper flange 148 may still allow e.g., an operator or maintenance personnel to align horizontal joint surface 150 and upper surface 170 without removing semi-annular diaphragm segment 130. Bolts 134 are shown in FIGS. 4, 7-8 and 11 in phantom indicating that bolts 134 may optionally be used in those embodiments as well.

As is further shown in FIG. 4, upper casing half 128 may be formed with a slot, bend, groove, etc. for receiving upper flange 148 and one or more shims 158 placed therebetween. Additionally, in an optional embodiment, one or more shims 158 may be joined to upper flange 148 via a bolt 136, the bolt 136 being accessible from above upper surface 170. Shims 158 may include, for example, a low chrome (Cr) steel, a chromium-nickel-tungsten-cobalt alloy, or any other material resistant to wear and known in the art.

As is shown in FIG. 4, in one embodiment, first flange 144 may be complementary to first portion 162 of slot 160 and second flange 146 may be complementary to second portion 164 of slot 160. Similarly, hook 143 may be complementary to a portion of lip 161 (e.g., engaging a radially inward portion of lip 161). It is understood that as used herein, the term "complementary" refers to a relationship between surfaces in which portions of those surfaces may be arranged substantially aligned with one another. For example, in one embodiment, surfaces of first flange 144 may be arranged substantially aligned with a wall of the first portion 162 of slot 160. Further, surfaces of second flange 146 may be arranged substantially aligned with a wall of the second portion 164 of slot 160.

In one embodiment, as is best shown and described later with respect to FIG. 12, support bar 140 (and other support bars shown and described herein) is demountably joined to semi-annular diaphragm segment 130 in an axial direction (A) (e.g., a direction parallel with a central axis of the semi-annular diaphragm segment 130, shared with the turbine rotor). That is, support bar 140 is capable of moving between semi-annular diaphragm segment 130 and casing 120 in a direction along the axis of the steam turbine. In contrast to the prior art assembly of FIG. 3, support bar 140 (and other support bars shown and described herein) is capable of being removed from steam turbine nozzle support assembly 110 in an axial direction (A) without the need to remove semi-annular diaphragm segment 130 from within casing 120.

Figure 5:
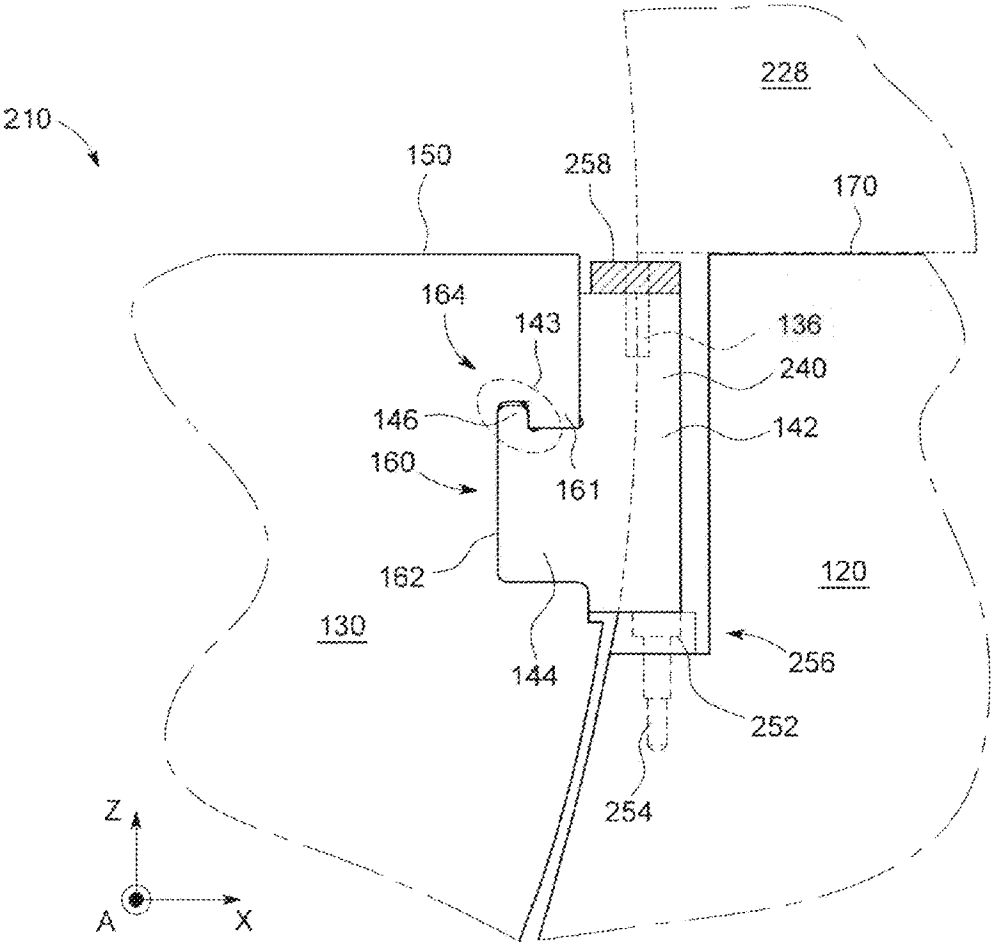

Turning to FIG. 5, another embodiment of a steam turbine nozzle assembly 210 is shown. It is understood that elements similarly numbered between FIG. 4 and FIG. 5 may be substantially similar as described with reference to FIG. 4. Further, in embodiments shown and described with reference to FIGS. 6-12, like numbering may represent like elements. Redundant explanation of these elements has been omitted for clarity. Returning to FIG. 5, steam turbine nozzle assembly 210 may include a support bar 240, which, similarly to support bar 140 (FIG. 4), may include a body portion 142 and a hook 143. Similarly to support bar 140 (FIG. 4), hook 143 may include portions of a first flange 144 extending substantially perpendicularly from body portion 142, and a second flange 146 extending substantially perpendicularly from first flange 144. However, in this embodiment, support bar 240 may not include upper flange 148 as shown and described with reference to FIG. 4. In this embodiment, alignment of horizontal joint surface 150 and upper surface 170 may be performed using a first shim 252 and at least one bolt 254 holding first shim 252 within a shoulder 256 of casing 120. First shim 252, bolt 254 and shoulder 256 may be substantially similar to those shown and described with reference to FIG. 3, and in conjunction with a second shim 258, may allow for alignment of support bar 240 within slot 160, and consequently, alignment of horizontal joint surface 150 and upper surface 170. As indicated, this steam turbine nozzle assembly 210 may further include second shim 258 above support bar 240, second shim 258 being substantially similar to second shim block 46 shown and described with reference to FIG. 3. Second shim 258 may be bolted or otherwise affixed to support bar 240 (e.g., using bolt 136). However, as in the embodiment of FIG. 4, support bar 240 of steam turbine nozzle assembly 210 is demountably joined to the semi-annular diaphragm segment 130 in an axial direction. As support bar 240 is not bolted or otherwise affixed to either of casing 120 or semi-annular diaphragm segment 130 (unlike first shim 252), support bar 240 may be removed axially from steam turbine nozzle assembly 210. Further, as support bar 240 is not bolted to semi-annular diaphragm segment 130 (e.g., in the x direction), greater clearance is afforded for bolting at the horizontal joint surface 150. As described with reference to FIG. 4, hook 143 allows larger bolts or coupling mechanisms to be used to penetrate semi-annular diaphragm segment 130 (at horizontal joint surface 150) in the z direction. Additionally, FIG. 5 shows an upper casing half 228 formed without the slot (or bend, groove, etc.) of upper casing half 128 of FIG. 4. In this case, as in those embodiments not including upper flange 148, upper casing half 228 may be substantially similar to a conventional upper casing half known in the art.

Figure 6:
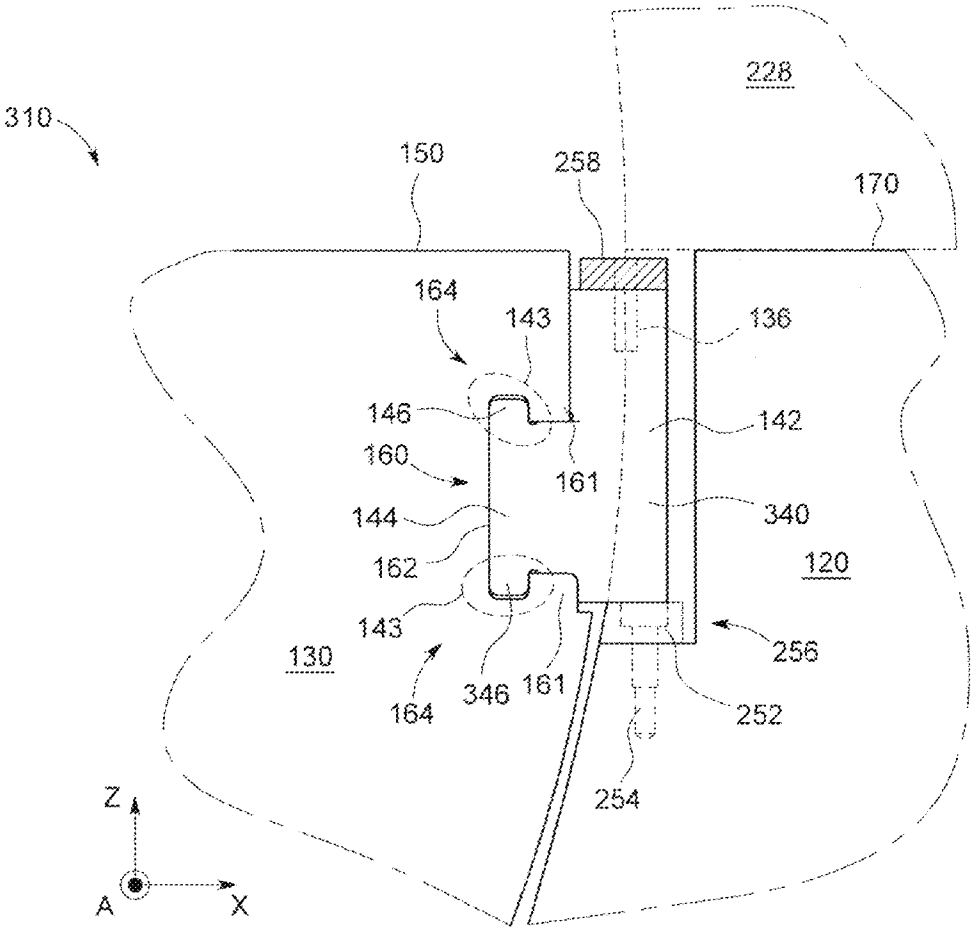

Turning to FIG. 6, a steam turbine nozzle assembly 310 is shown according to another embodiment. This embodiment includes a support bar 340, which, similarly to support bar 140 (FIG. 5), may include a body portion 142 and a hook 143. Similarly to support bar 140 of FIG. 5, hook 143 may include portions of a first flange 144 extending substantially perpendicularly from body portion 142, and a second flange 146 extending substantially perpendicularly from the first flange 144. However, in steam turbine nozzle assembly 310 of FIG. 6, second portion 164 of the slot extends from the first portion 162 of the slot 160 in two opposing directions, forming a second lip 161 extending toward first lip 161. In this case, support bar 340 may further include an additional hook 143 (indicated by phantom circle) extending in an opposite direction (e.g., downwardly in the z direction) from hook 143. Specifically, in one embodiment, support bar 340 may further include a third flange 346 extending substantially perpendicularly from first flange 144 (flanges collectively forming hook 143) and in an opposite direction from second flange 146. In this embodiment, the opposing hooks (143), and similarly, opposing flanges (146, 346) may provide increased mechanical stability of support bar 340 as compared with support bar 240 of FIG. 5. In this embodiment, as with steam turbine nozzle assembly 210 of FIG. 5, support bar 340 is demountably joined to semi-annular diaphragm segment 130 in an axial direction (A) (and is removable in the axial direction after removal of second shim 258). Further, as support bar 340 is not bolted to semi-annular diaphragm segment 130 (e.g., in the x direction), greater clearance is afforded for bolting at the horizontal joint surface 150. As described with reference to FIG. 5, hooks 143 allow larger bolts or coupling mechanisms to be used to penetrate semi-annular diaphragm segment 130 (at horizontal joint surface 150) in the z direction.

Figure 7:
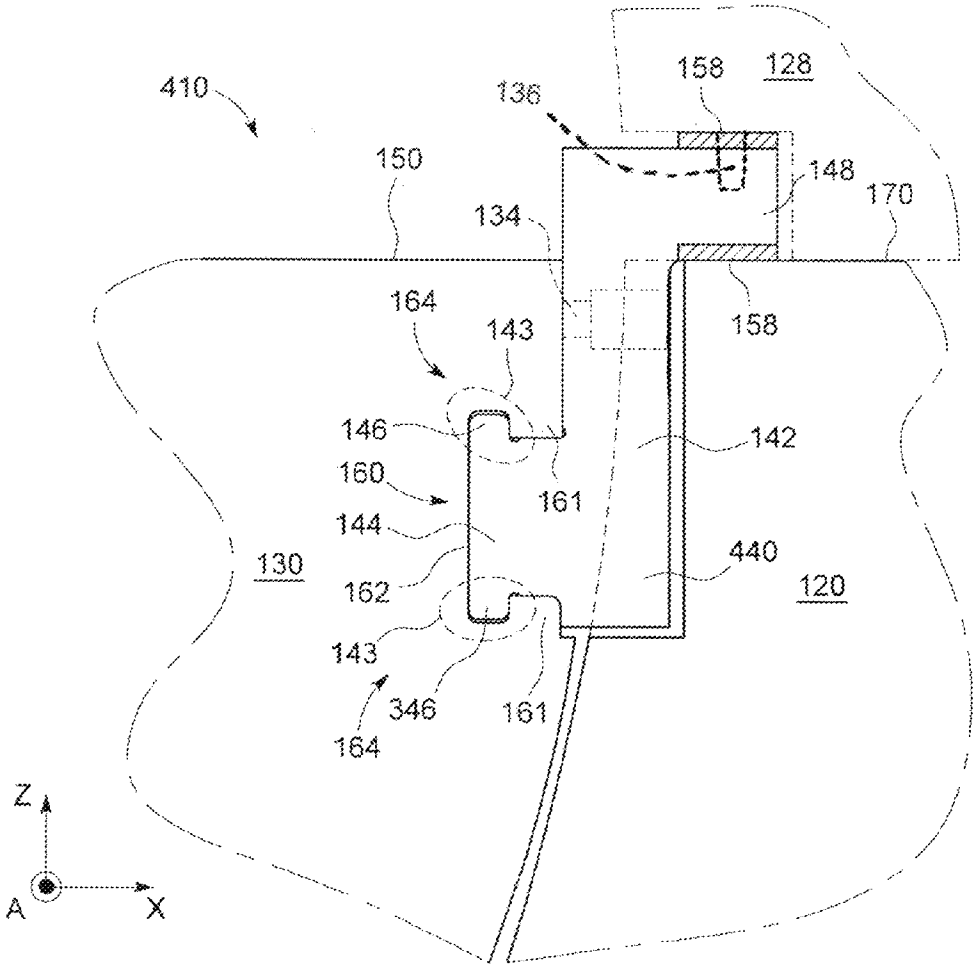

Turning to FIG. 7, a steam turbine nozzle assembly 410 is shown according to another embodiment. This embodiment may combine features shown and described with reference to previously-discussed figures, and more specifically, steam turbine nozzle assembly 410 may include an upper flange 148 and an upper shim 158 (as shown and described with reference to FIG. 4). Further, steam turbine nozzle assembly 410 may include a support bar 440, which may include a body portion 142 and hooks 143 (similarly shown and described with reference to FIG. 6). Hook 143 may include portions of a first flange 144 extending substantially perpendicularly from the body portion 142, and a second flange 146 extending substantially perpendicularly from first flange 144. As in steam turbine nozzle assembly 310 of FIG. 6, second portion 164 of slot 160 extends from first portion 162 of slot 160 in two opposing directions. As also discussed with reference to FIG. 6, support bar 340 may further include a third flange 346 (forming part of additional hook 143, shown in phantom circle) extending substantially perpendicularly from first flange 144 and in an opposite direction from second flange 146. In this embodiment, as with the steam turbine nozzle assembly 110 shown and described with reference to FIG. 4, support bar 440 is demountably joined to semi-annular diaphragm segment 130 in an axial direction (A) and is adjustable (e.g., via access to shims 158) from a point above upper surface 170 and horizontal joint surface 150. Further, in the embodiment where support bar 440 is not bolted to semi-annular diaphragm segment 130 (e.g., in the x direction), greater clearance is afforded for bolting at the horizontal joint surface 150. It is also understood that in an alternative embodiment, support bar 440, similarly to support bar 140 of FIG. 4, may be formed without hooks 143, and may use one or more bolts 134 to secure support bar to semi-annular diaphragm segment 130.

Figure 8:
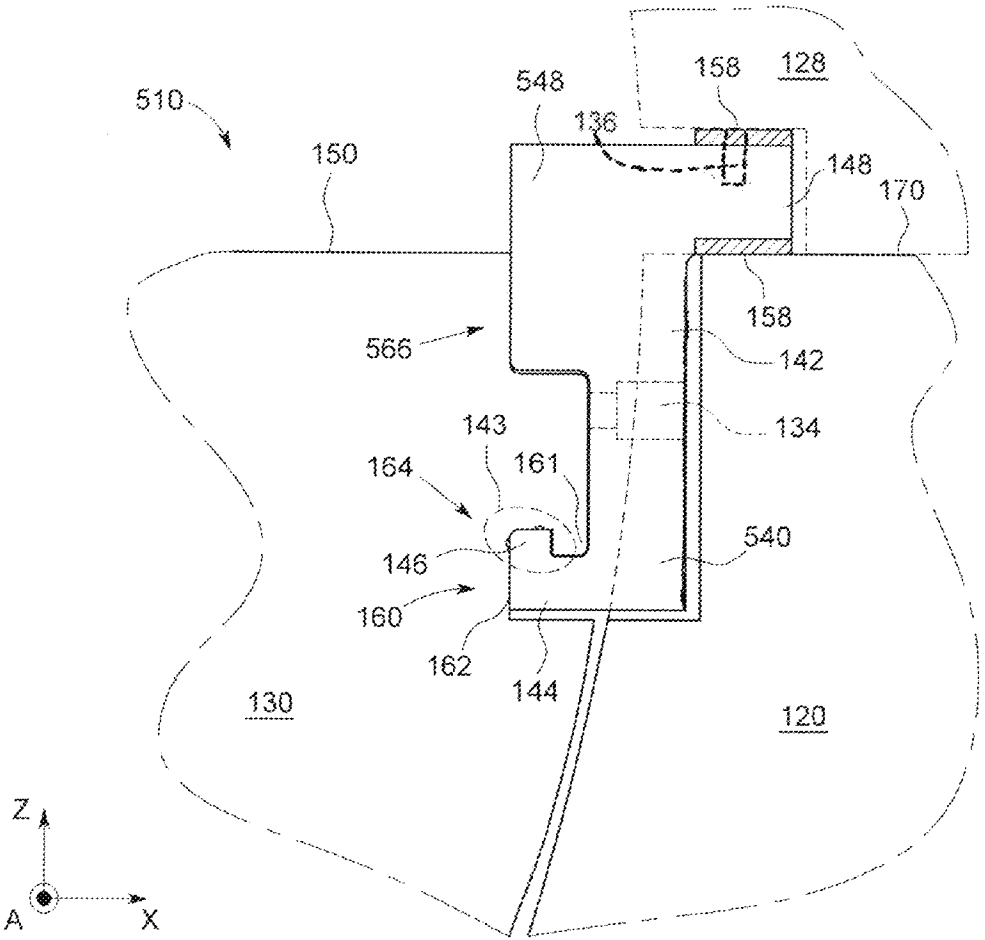

Turning to FIG. 8, a steam turbine nozzle assembly 510 is shown according to another embodiment. This embodiment may include features shown and described with reference to FIG. 4, as well as additional features. For example, steam turbine nozzle assembly 510 may include a support bar 540, which, similarly to support bar 140 (FIG. 4), may include a body portion 142 and a hook 143. Hook 143 may include portions of a first flange 144 extending substantially perpendicularly from body portion 142, and a second flange 146 extending substantially perpendicularly from first flange 144. In this embodiment, support bar 540 may further include a third flange 548 extending substantially perpendicularly from body portion 142 and radially inwardly over a seat 566 within the semi-annular diaphragm segment 130. Third flange 548 may further extend above (e.g., in the z-direction) horizontal joint surface 150. In this case, a second (or upper) semi-annular diaphragm ring segment (e.g., segment 20 of FIG. 2) may include a slot or opening (not shown) for receiving the portion of third flange 548 extending above the horizontal joint surface 150. As shown, seat 566 includes a surface distinct from the first and second portions of slot 160 (and similarly, lip 161). That is, support bar 540 may partially surround (e.g., contact on three sides) a portion of semi-annular diaphragm segment 130. Support bar 540 may also include a fourth flange (or simply, upper flange) 148, similarly shown and described with reference to FIG. 4 (along with upper shim 158). In this embodiment, as with steam turbine nozzle assemblies 110, 410 shown and described with reference to FIGS. 4 and 7, support bar 540 is demountably joined to semi-annular diaphragm segment 130 in an axial direction (A) and is adjustable (e.g., via access to shims 158) from a point above upper surface 170 and horizontal joint surface 150. Further, in the embodiment where support bar 540 is not bolted to semi-annular diaphragm segment 130 (e.g., in the x direction), greater clearance is afforded for bolting at the horizontal joint surface 150. It is also understood that in an alternative embodiment, support bar 540, similarly to support bar 140 of FIG. 4, may be formed without hooks 143, and may use one or more bolts 134 to secure support bar to semi-annular diaphragm segment 130.

Figure 9:
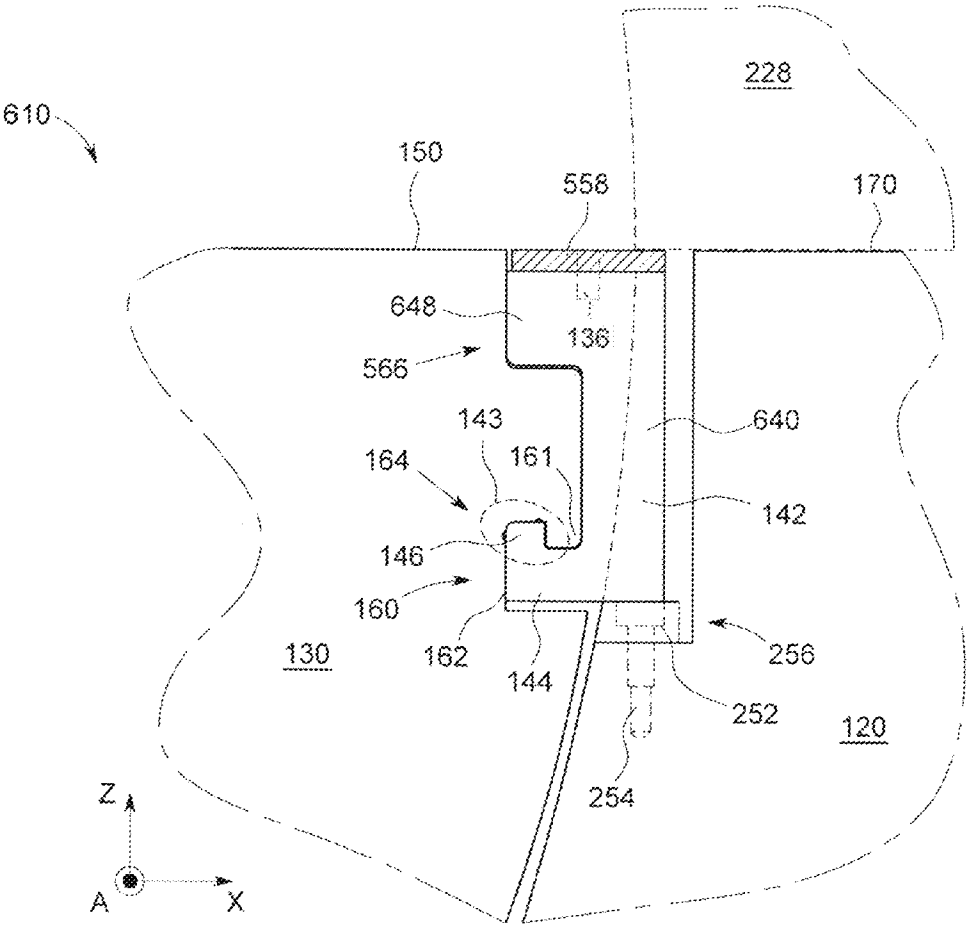

Turning to FIG. 9, a steam turbine nozzle assembly 610 is shown according to another embodiment. This embodiment may include features shown and described with reference to FIGS. 5-6 and 8, as well as additional features. For example, steam turbine nozzle assembly 610 may include a support bar 640, which, similarly to support bar 540 (FIG. 8), may include a body portion 142 and a hook 143. As described with reference to FIG. 8, hook 143 may include portions of a first flange 144 extending substantially perpendicularly from the body portion 142, and a second flange 146 extending substantially perpendicularly from first flange 144. Further, in this embodiment, support bar 640 may further include a third flange 648 extending substantially perpendicularly from body portion 142 and radially inwardly over a seat 566 within semi-annular diaphragm segment 130. In contrast to support bar 540 of FIG. 8, support bar 640 of this embodiment does not extend above (e.g., in the z-direction) horizontal joint surface 150. In this embodiment, an upper shim 558 may be used to help mechanically stabilize support bar 640 in steam turbine nozzle assembly 610. Upper shim 558 may be formed of similar materials as shims 158, 258 described with reference to FIGS. 4-8. However, in contrast to shims 158, 258, upper shim 558 may extend inwardly radially over a portion of semi-annular diaphragm segment 130. That is, upper shim 558 may extend over third flange 648, which in turn extends over seat 566 within semi-annular diaphragm segment 130. In contrast to the embodiment of FIG. 8, use of support bar 640 and upper shim 558 may eliminate or reduce the need for a slot or opening in the second (or upper) semi-annular diaphragm ring segment (e.g., segment 20 of FIG. 2), as third flange 648 does not extend above (e.g., in the z-direction) horizontal joint surface 150. In this embodiment, as with steam turbine nozzle assemblies 510, 610 shown and described with reference to FIGS. 5 and 6, support bar 640 is demountably joined to semi-annular diaphragm segment 130 in an axial direction (A). Further, as support bar 640 is not bolted to semi-annular diaphragm segment 130 (e.g., in the x direction), greater clearance is afforded for bolting at the horizontal joint surface 150. As described with reference to FIGS. 5 and 6, hooks 143 allow larger bolts or coupling mechanisms to be used to penetrate semi-annular diaphragm segment 130 (at horizontal joint surface 150) in the z direction.

Figure 10:
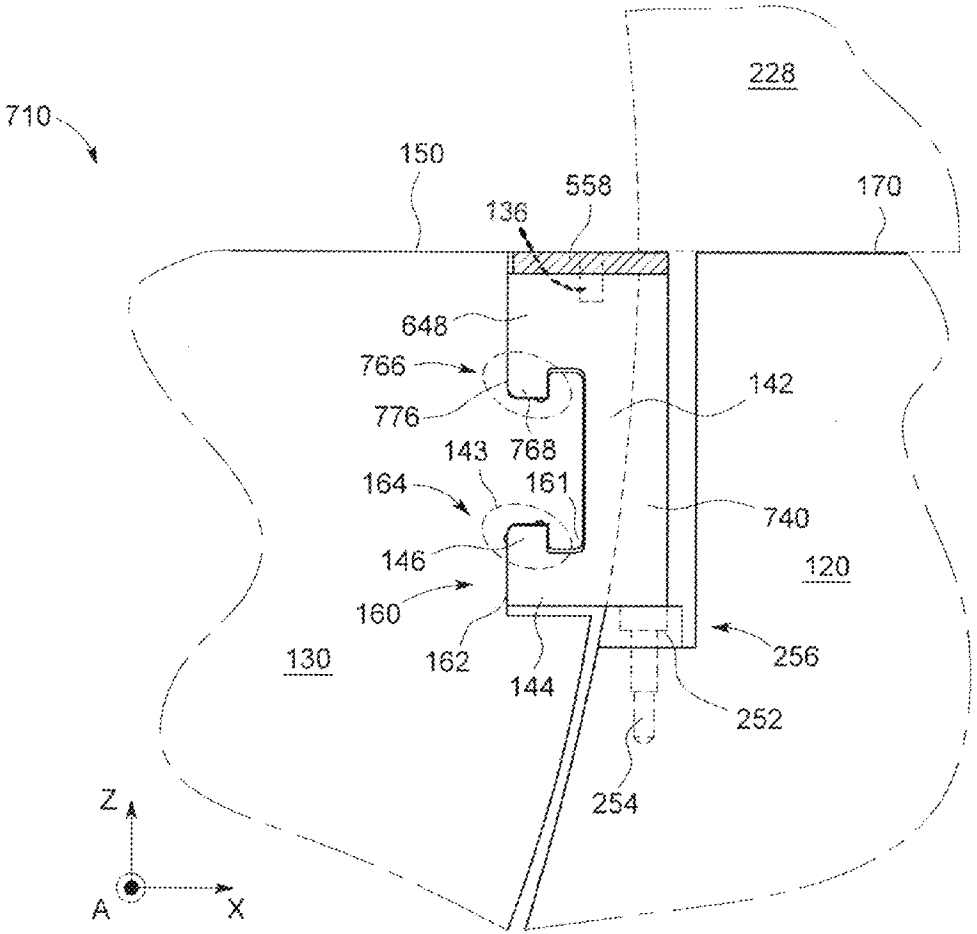

Turning to FIG. 10, a steam turbine nozzle assembly 710 is shown according to another embodiment. This embodiment may include features shown and described with reference to FIG. 9, as well as additional features. For example, steam turbine nozzle assembly 710 may include a support bar 740, which, similarly to support bar 640 (FIG. 9), may include a body portion 142 and hooks 143 (extending inwardly toward one another). Hook 143 may include portions of a first flange 144 extending substantially perpendicularly from the body portion 142, and a second flange 146 extending substantially perpendicularly from the first flange 144. Further, as with support bar 640 (FIG. 9), in this embodiment, support bar 740 may further include a third flange 648 extending substantially perpendicularly from body portion 142 and radially inwardly over a seat 766 within the semi-annular diaphragm segment 130. Support bar 740 may further include a fourth flange 768 (forming a portion of hook 143) extending substantially perpendicularly from the third flange 648. Fourth flange 768 may extend from third flange 648 toward second flange 146 and may aid in mechanically coupling support bar 740 to semi-annular diaphragm segment 130 in a radial (e.g., along x-axis) direction. Fourth flange 768 may extend over a portion of seat 766 within semi-annular diaphragm segment 130, where seat 766 has a recess 776 for receiving fourth flange 768. Further, fourth flange 768 may substantially complement recess 776, in a similar fashion as second flange 146 complements second portion 164 of slot 160. Similarly to support bar 640 of FIG. 9, support bar 740 of this embodiment does not extend above (e.g., in the z-direction) horizontal joint surface 150. In this embodiment, upper shim 558 may be used to aid in mechanically stabilizing support bar 740 in steam turbine nozzle assembly 710. In this embodiment, as with steam turbine nozzle assembly 610 of FIG. 9, support bar 740 is demountably joined to semi-annular diaphragm segment 130 in an axial direction (A). Further, as support bar 740 is not bolted to semi-annular diaphragm segment 130 (e.g., in the x direction), greater clearance is afforded for bolting at the horizontal joint surface 150. As described with reference to FIGS. 5, 6 and 9, hooks 143 allow larger bolts or coupling mechanisms to be used to penetrate semi-annular diaphragm segment 130 (at horizontal joint surface 150) in the z direction.

Figure 11:
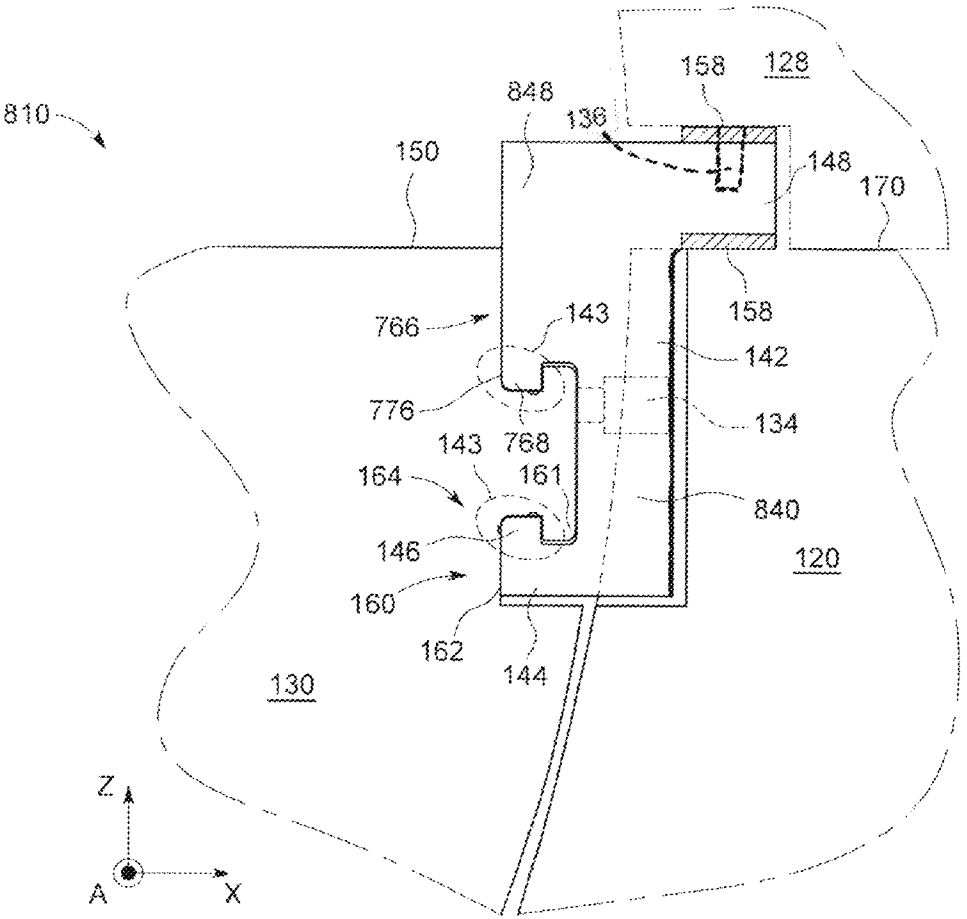

Turning to FIG. 11, a steam turbine nozzle assembly 810 is shown according to another embodiment. This embodiment may include features shown and described with reference to FIGS. 8-10, as well as additional features. For example, steam turbine nozzle assembly 810 may include a support bar 840, which, similarly to support bar 540 (FIG. 8), may include a body portion 142 and a hook 143. Hook 143 may include portions of a first flange 144 extending substantially perpendicularly from body portion 142, and a second flange 146 extending substantially perpendicularly from first flange 144. In this embodiment, support bar 840 may further include a third flange 848 (forming part of an additional hook 143) extending substantially perpendicularly from body portion 142 and radially inwardly over a seat 766 (similarly shown and described with reference to FIG. 10) within semi-annular diaphragm segment 130. Third flange 848 may further extend above (e.g., in the z-direction) horizontal joint surface 150. In this case, a second (or upper) semi-annular diaphragm ring segment (e.g., segment 20 of FIG. 2) may include a slot or opening (not shown) for receiving the portion of third flange 848 extending above horizontal joint surface 150. As shown, seat 766 includes a surface distinct from the first and second portions of slot 160. Further, as is described with reference to FIG. 10, seat 766 may include a recess 776 for receiving a fourth flange 768 (forming part of additional hook 143). Support bar 840 may also include a fifth flange (or simply, upper flange) 148, similarly shown and described with reference to FIGS. 4 and 8 (along with upper shim 158). In this embodiment, as with steam turbine nozzle assemblies 110, 510 shown and described with reference to FIGS. 4 and 8, support bar 840 is demountably joined to semi-annular diaphragm segment 130 in an axial direction (A) and is adjustable (e.g., via access to shims 158) from a point above upper surface 170 and horizontal joint surface 150. Further, in the embodiment where support bar 840 is not bolted to semi-annular diaphragm segment 130 (e.g., in the x direction), greater clearance is afforded for bolting at the horizontal joint surface 150. It is also understood that in an alternative embodiment, support bar 840, similarly to support bar 140 of FIG. 4, may be formed without hooks 143, and may use one or more bolts 134 to secure support bar to semi-annular diaphragm segment 130.

Figure 12:
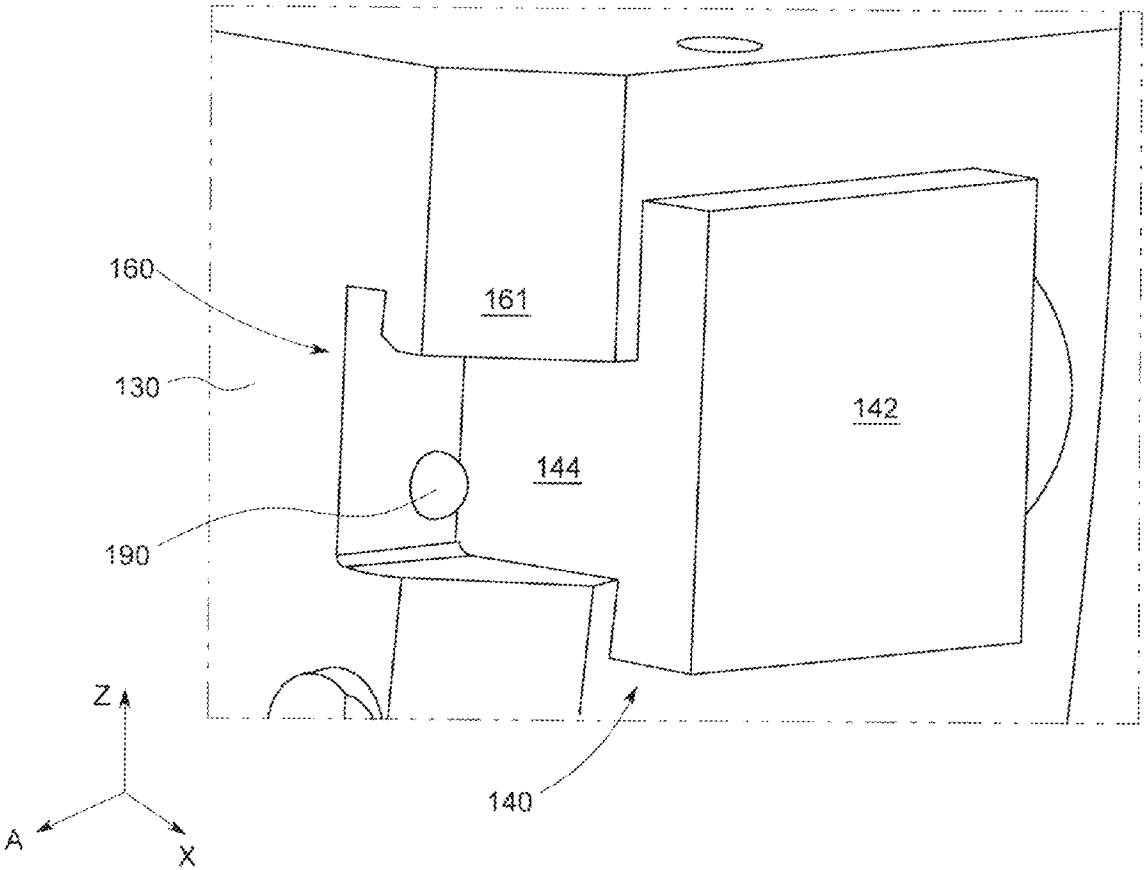
FIG. 12 shows a three-dimensional perspective view of a partial end elevation of a steam turbine nozzle support assembly according to an embodiment of the invention.

Turning to FIG. 12, a three-dimensional perspective view of a partial end elevation of a steam turbine nozzle support assembly according to embodiments of the invention is shown. While this partial end elevation may most closely resemble portions of FIGS. 4-5, it is understood that the components of FIG. 12 and their accompanying descriptions may be applied to any embodiment described herein. As shown in this three-dimensional perspective view, support bar 140 may be formed as a unitary (or, uninterrupted) structure. That is, in contrast to support bar 32 of the prior art (FIG. 3), support bar 140 is devoid of apertures extending therethrough. As shown, support bar 140 may include a body portion 142, a first flange 144 extending substantially perpendicularly from body portion 142, and a second flange 146 (hidden from this perspective) extending substantially perpendicularly from first flange 144. As described herein, first flange 144 and second flange 146 may form portions of a hook 143 (hidden from this perspective). Further shown in FIG. 12 is a member 190 removably affixed to semi-annular diaphragm segment 130. The member 190 may retain the support bar 140 in slot 160 by preventing movement of support bar 140 in the axial direction (A). Member 190 may be removably affixed to a wall of slot 160 in any manner known in the art. For example, where member 190 is a screw, pin, knob, a "TIG-tack" weld, etc., member 190 may be removably affixed to a wall of slot 160 via, e.g., threading, engaging a slot, fastening, etc. It is understood that member 190 may be affixed to a wall of slot 160 in a non-permanent manner, such that, e.g., an operator may remove member 190 from a wall of slot 160 using conventional tools or grinding of a small weld. It is further understood that member 190 may be removably affixed to any wall of slot 160 that allows for member 190 to prevent movement of support bar 140 in the axial direction (A). Additionally, a plurality of members 190 may be removably affixed to one or more walls of slot 160 to prevent movement of support bar 140 in the axial direction (A).

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A steam turbine support bar comprising:

a body portion;

a first flange extending substantially perpendicularly from the body portion; and a second flange extending substantially perpendicularly from the first flange so as to form a hook-shaped portion for engaging a lip portion of a steam turbine diaphragm, wherein the steam turbine support bar is configured to non-affixedly join a steam turbine casing to the steam turbine diaphragm, wherein the first flange and the second flange form a unitary structure, without any apertures therethrough, and wherein the first flange and the second flange forming the hook-shaped portion is configured to engage the lip portion of the steam turbine diaphragm without a screw, a bolt, or an adhesive.

2. The steam turbine support bar of claim 1, wherein the hook-shaped portion extends outwardly from the body portion and upwardly to engage the lip portion of the steam turbine diaphragm.

3. The steam turbine support bar of claim 2, further comprising an upper flange extending from the body portion and configured to engage an upper surface of the steam turbine casing.

4. The steam turbine support bar of claim 3, wherein the upper flange and the hook-shaped portion extend in opposite directions from the body portion.

5. A steam turbine nozzle support assembly comprising:

a steam turbine casing;

a semi-annular diaphragm segment at least partially housed within the steam turbine casing, the semi-annular diaphragm segment having a horizontal joint surface and a lip portion for non-affixedly engaging a steam turbine support bar;

a slot having:

a first portion extending substantially parallel to the horizontal joint surface; and a second portion extending substantially perpendicularly from the first portion;

wherein the steam turbine support bar is removably arranged between the steam turbine casing and the semi-annular diaphragm segment, the support bar substantially filling the slot and including:

a body portion;

a first flange extending substantially perpendicularly from the body portion; and a second flange extending substantially perpendicularly from the first flange so as to form the hook-shaped portion joining the steam turbine casing and the semi-annular diaphragm segment, wherein the hook-shaped portion is a unitary structure without any apertures therethrough, and wherein the first flange and the second flange forming the hook-shaped portion engage the lip portion of the semi-annular diaphragm segment without a screw, a bolt, or an adhesive.

6. The steam turbine nozzle support assembly of claim 5, wherein the lip portion extends in a direction away from the horizontal joint surface.

7. The steam turbine nozzle support assembly of claim 5, wherein the first flange is complementary to the first portion of the slot and the second flange is complementary to the second portion of the slot.

8. The steam turbine nozzle support assembly of claim 5, wherein the support bar is demountably joined to the semi-annular diaphragm segment in a direction parallel with an axis of the semi-annular diaphragm segment.

9. The steam turbine nozzle support assembly of claim 5, wherein the support bar further includes a third flange extending substantially perpendicularly from the body portion and radially outwardly over an upper surface of the steam turbine casing, the third flange allowing for horizontal alignment of the upper surface with the horizontal joint surface.

10. The steam turbine nozzle support assembly of claim 9, further comprising a demountably placed shim located between an upper surface of the third flange and below a lower surface of an upper portion of the steam turbine casing.

11. The steam turbine nozzle support assembly of claim 5, wherein the support bar further includes a third flange extending substantially perpendicularly from the body portion and radially inwardly over a seat within the semi-annular diaphragm segment, the seat including a surface distinct from the first and second portions of the slot.

12. The steam turbine nozzle support assembly of claim 11, wherein the support bar further includes an upper flange extending substantially perpendicularly from the body portion and radially outwardly over an upper surface of the steam turbine casing, the upper flange allowing for horizontal alignment of the upper surface with the horizontal joint surface.

13. The steam turbine nozzle support assembly of claim 5, wherein the steam turbine support bar further includes a third flange extending substantially perpendicularly from the first flange so as to form a second hook-shaped portion further joining the steam turbine casing and the semi-annular diaphragm segment, wherein the semi-annular diaphragm segment further includes a second lip portion substantially facing the lip portion for non-affixedly engaging the second hook-shaped portion of the steam turbine support bar.

14. The steam turbine nozzle support assembly of claim 5, wherein the second portion of the slot extends from the first portion of the slot in two opposing directions, and wherein the support bar further includes a third flange extending substantially perpendicularly from the first flange and in an opposite direction from the second flange.

15. A steam turbine apparatus comprising:

a casing having a horizontal joint surface;

a rotor within the casing; and a steam turbine nozzle support assembly including:

a semi-annular diaphragm segment at least partially housed within the casing, the semi-annular diaphragm segment having a slot; and a support bar removably arranged between the casing and the semi-annular diaphragm segment, the support bar including:

a body portion a first flange extending substantially perpendicularly from the body portion and substantially filling the slot, and a second flange extending substantially perpendicularly from the first flange so as to form a hook-shaped portion engaging a lip portion of the semi-annular diaphragm segment and joining the casing and the semi-annular diaphragm segment, wherein the hook-shaped portion is a substantially unitary structure without any apertures therethrough, and wherein the first flange and the second flange forming the hook-shaped portion engage the lip portion of the semi-annular diaphragm segment without a screw, a bolt, or an adhesive.

* * * * *